US006513621B1

(12) United States Patent
Deslauriers et al.

(10) Patent No.: US 6,513,621 B1
(45) Date of Patent: Feb. 4, 2003

(54) METHOD OF PRODUCING AND MAKING USE OF EAR TIPS HAVING A FILLED AIRTIGHT CHAMBER

(75) Inventors: Richard J. Deslauriers, Waterbury, CT (US); Robert T. Potash, South Windsor, CT (US); Lewis W. Chappel, New Hartford, CT (US)

(73) Assignee: Doctors Research Group, Plymouth, CT (US)

( * ) Notice: Subject to any disclaimer, the term of this patent is extended or adjusted under 35 U.S.C. 154(b) by 0 days.

(21) Appl. No.: 09/637,347

(22) Filed: Aug. 15, 2000

Related U.S. Application Data

(63) Continuation-in-part of application No. 09/592,785, filed on Jun. 13, 2000.

(51) Int. Cl.[7] ..... H04R 25/02

(52) U.S. Cl. ..... 181/130; 181/129; 181/135; 128/865

(58) Field of Search ..... 181/135, 134, 181/131, 130, 129; 381/322, 328, 380, 379, 68.6, 69, 138; 128/864, 865, 866; 2/423, 209

(56) References Cited

U.S. PATENT DOCUMENTS 2,803,308 A * 8/1957 Di Mattia ..... 181/135
2,888,921 A * 6/1959 Nielson et al. ..... 128/865
3,110,356 A * 11/1963 Mendelson ..... 128/865
3,303,902 A * 2/1967 Knott ..... 181/135
4,006,796 A * 2/1977 Coehorst ..... 128/865
4,133,984 A * 1/1979 Akiyama ..... 181/135
4,384,575 A * 5/1983 Asker ..... 128/865
4,852,684 A * 8/1989 Packard ..... 128/864
4,871,502 A * 10/1989 LeBisch et al. ..... 181/129
5,333,622 A * 8/1994 Casali et al. ..... 128/864
5,449,865 A * 9/1995 Desnick et al. ..... 181/131
5,483,027 A * 1/1996 Krause ..... 128/865
5,781,947 A * 7/1998 Sramek ..... 5/636
5,824,968 A * 10/1998 Packard et al. ..... 181/131
5,988,313 A * 11/1999 H.ang.kansson ..... 181/135

* cited by examiner

*Primary Examiner*—Robert E. Nappi
*Assistant Examiner*—Edgardo San Martin

(57) ABSTRACT

This invention discloses an ear tip used in connection with a stethoscope. Whereby the disclosed ear tip is formed of a single piece of molded elastomeric material that is inverted and sealed to form a sealed chamber that is filled with a liquid gelatin, whereby standard loads deform the liquid gelatin filled cavity under principles of displacement providing for the ear tips capability of contouring to the infinite variations and configurations of different outer ear canals, and thereby creating a complete acoustic seal between the outer surface of the ear tip and the outer ear of the user. Furthermore, this invention discloses a means of attachment to a listening device that facilitates the attachment and removal of the ear tip to the listening device.

11 Claims, 3 Drawing Sheets

METHOD OF PRODUCING AND MAKING USE OF EAR TIPS HAVING A FILLED AIRTIGHT CHAMBER

CROSS-REFERENCE TO RELATED APPLICATION

This application is a Continuation-in-Part of U.S. patent application Ser. No. 09/592,785 filed on Jun. 13, 2000 entitled "Filled Hollow Cavity Displaceable Ear Tips."

STATEMENT REGARDING FEDERALLY SPONSERED RESEARCH AND DEVELOPMENT

Not Applicable

REFERENCE TO MICROFICHE APPENDIX

Not Applicable

BACKGROUND OF THE INVENTION

This invention relates to the field of diagnostic medical devices and in particular the manufacture of ear tips for use on a binaural stethoscope. The prior art in the field discloses a number of types of ear tips for use on a stethoscope or other similar devices. Ear tips are generally manufactured out of an elastomeric material so to provide enough flexibility in the shape and comfort during their use; less frequently ear tips are manufactured using a more rigid material providing more durability but decreased comfort. Regardless of the actual rigidity of the material used, the process of injection molding is the preferred method of forming a specific ear tip, whereby a material, such as PVC (polyvinylchloride), is injected into a forming mold where the material hardens to form the desired shape. Ear tips are generally comprised of two sections, where the first section houses a means of attachment to the binaural and the second section interfaces with the auditory canal of a user's ear.

Ear tips disclosed in prior art teach the use of compression, whereas certain internal and outer diameters are held during the manufacture such that the required compression ratios are generated by the application of axial forces (U.S. Pat. Nos. 4,852,684, 4,913,259, 5,288,953). The compression ratios serve to allow for a degree of flexibility in the ear tip while being fit into the ear and further serves to provide for enough resistance so that the ear tip does not collapse. Though compressible ear tips provided some degree of comfort and provide for some conformity to individual ear shapes, due to the compressible nature of these ear tips they do not conform to the infinite variations of ear shapes, and do not provide for a wholly airtight seal when inserted into an ear.

Other art teaches the use of a foam earpiece capable of achieving slow compression rates as a method of achieving both comfort and a complete acoustic seal (U.S. Pat. No. 4,724,942).

This disclosed invention teaches a method for how to make use of an ear tip having a liquid gelatin, saline, gas, or other fluid inserted into a sealed airtight chamber with a true audio port for the passage of sound. The result of the gel chamber is that the ear tip will operate using principles of displacement within the sealed chamber that act to expand circumferentially throughout the linear cross section geometry, thereby forming a complete and continuous acoustic seal with the user's outer auditory canal. This invention further teaches a manner in which a displaceable ear tip is attached to a soundtransmitting device such as a stethoscope. Finally the disclosed invention teaches a method of manufacturing such an ear tip.

BRIEF DESCRIPTION OF THE INVENTION

The preferred embodiment of the disclosed invention comprises a liquid gelatin filled ear tip as a single, functional unit for coupling sound from the binaural to the user's auditory canal through a center auditory passage, and which ear tip has a first section designed to interface with a listening device and a second section to interface with a human ear that encapsulates a sealed airtight chamber. The disclosed ear tip is manufactured from a soft elastomeric material, such as PVC or other thermoplastic or liquid injection molding material, such as silicone, but may be manufactured of any material offering elastomeric properties, to form a singular elastomeric form. The ear tip is formed so that there is a top section of a minimum wall thickness having a beveled portion on the external surface at the end of the top section, that when inverted mates with the bottom section and whereby the aforesaid minimum wall thickness forms the outer wall of the sealed chamber within the second section. The bottom section with walls of greater thickness provides for the center auditory passage, a means of attachment to a listening device and an indentation to receive the beveled edge, such that when the beveled edge is sealed to the indentation adhesive peel is eliminated. The one piece molded form is turned inside itself so as to create an outer wall and an inner wall, which inner wall also serves as the exterior wall of the center auditory passage; and whereby the exterior wall is of a great enough thickness preventing the compression or the collapse of the center auditory passage, and the outer wall is a minimum thickness such to allow sufficient flexibility and expansion of the sealed airtight chamber housed in the second section upon the exertion of external forces. After the top section of the molded form is inverted, the beveled edge of the top section mates with the molded recess of the bottom section and is sealed with an adhesive agent or other method used to create a seal. After the top section is sealed to the bottom section, a fluid is injected into the sealed airtight chamber formed by the outer wall and the inner wall, and the injection hole is subsequently sealed.

The fluid filled ear tips establish a maximum acoustic seal and provide for minimum discomfort associated with extensive use of the invention. The device is designed to displace and deform under standard radial loads associated with inserting the stethoscope ear tip into one's ear canal, and where the center sound passage remains constant and unaffected by the flexing or expansion of the filled chamber thereby allowing sound to travel through the chamber unobstructed. The full expansion, that results from displacement within the chamber, of the disclosed invention within the user s ear canal creates a complete and continuous acoustic seal thereby significantly reducing the infiltration of ambient noise.

The present invention comprises a first section that houses a bullet point shaped receptacle within the ear tip that interfaces with a matching bullet point shaped distal end of a stethoscope. The second section provides for an airtight hollow chamber that encapsulates a liquid gelatin. As a result of the liquid gelatin chamber of the second section, the portion of the device interfacing with a user's ear, the ear tip contours to the infinite variations of different individual's ear canal shape by circumferentially filling in the linear variations within a user's ear. Infinite variations are achieved under the principles of displacement, whereby the volume of the airtight cavity is fixed and does not change when pushed.

Thus, when the disclosed ear tip is inserted into the ear, the high points within the ear push against the exterior of the second section and the ear tip pushes back because of displacement into the lower points thereby creating a complete seal with the ear. Therefore, the singular design for this ear tip provides for a custom fit to an infinite number of users. The device also provides for a true communication port with user's ear canal.

Furthermore, in the preferred embodiment, the material used to fill the chamber is selected such that the material at normal body temperature of 98.6° remains resistant such that the ear tip is solid enough to completely contour to all of the spaces and linear irregularities within a user's ear canal. Furthermore, the material selected remains pliant when the ear tips are exposed to freezing temperatures, such that the ear tips do not crack under extreme temperatures.

In another preferred embodiment of the disclosed invention, the sealed airtight chamber is filled with a gaseous substance or matter such as nitrogen so as to be entirely displaceable.

In another preferred embodiment of the disclosed invention, the sealed airtight chamber is filled with saline so as to be entirely displaceable.

In another preferred embodiment of the disclosed invention, the sealed airtight chamber is filled with a foam material so as to be entirely displaceable.

In another preferred embodiment of the disclosed invention, the sealed airtight chamber of the ear tip is filled with any substance or combination of substances known in the field, such as silicone, oil or water, or other such substance not yet invented so as to be entirely displaceable.

In another preferred embodiment of this invention, the disclosed ear tip is impregnated with an anti-microbial agent. The inclusion of an anti-microbial agent into the ear tip reduces the number of times that the ear tips must be sterilized by allowing the ear tip to remain free from bacteria from the user's ear, other users of the same stethoscope, or from patients being diagnosed.

In yet another embodiment, the disclosed ear tip is designed such that a bullet point receptacle, within the first section, secures the ear tip to the binaural of the stethoscope thereby preventing the ear tip from inadvertently disengaging from the ear tip binaural of the stethoscope. This is a particular concern with standard threaded ear tips frequently unscrewing from the user's stethoscope binaural or disengaging from a standard stethoscope barb. This feature also allows the ear tip to be removed for cleaning without a concern for creating a substandard seal after the reattachment of the ear tip to the stethoscope, and thereby offering an ear tip with substantially improved durability, and which does not necessitate frequent replacement.

DETAILED DESCRIPTION OF THE INVENTION

Figure 1A:
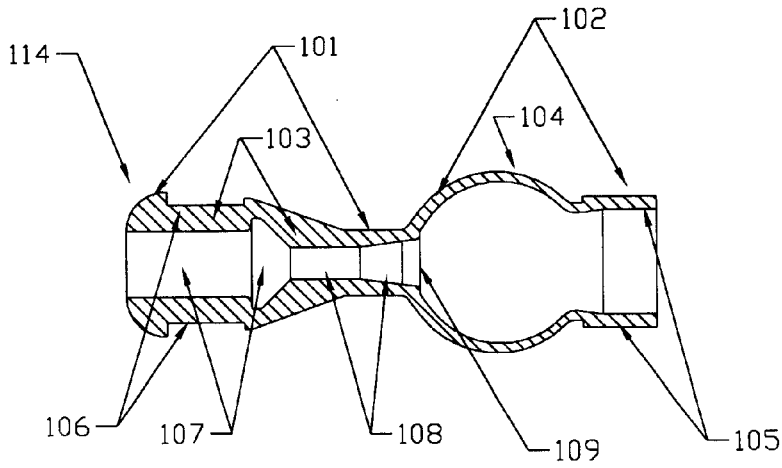
FIG. 1A depicts the elastomeric form of the ear tip prior to inversion.

FIG. 1A shows by schematic the layout of the molded elastomeric design that is created utilizing the process of injection molding. The molded ear tip incorporates a series of characteristics that enable the ear tip to achieve its desired results of a comfortable fit and a complete and continuous acoustic seal. FIG. 1A shows that the molded ear tip is comprised of two main sections Bottom Section 101 and Top Section 102. Bottom Section 101 is designed such that Bottom Wall Thickness 103 is greater than Top Wall Thickness 104 of Top Section 102. FIG. 1A further shows the incorporation of Beveled Edge 105, which is located on the exterior of Top Section 102, and its mating section Indentation 106, which is located on the exterior of the Bottom Section 101. Bullet Point Receptacle 107 is located within Bottom Section 101 and continues through Bottom Section 101 until it meets with Center Auditory Passage 108. Bullet Point Receptacle 107 is the method used to attach Ear tip 114 to a binaural of a stethoscope, whereas Bullet Point Receptacle 107 is specifically sized as to be smaller in diameter than the matching bullet point binaural such that the Ear tip 114 attaches securely to the stethoscope binaural, but not small enough to impede the attachment of Ear tip 114 to Stethoscope Binaural. Center Auditory Passage 108 is shown extending from the end of the Bullet Point Receptacle 107 to the Audio Port 109, and where the Center Auditory Passage is contained in Bottom Section 101 such that the Center Auditory Passage 108 is formed by the Bottom Wall Thickness 103.

Figure 1B:
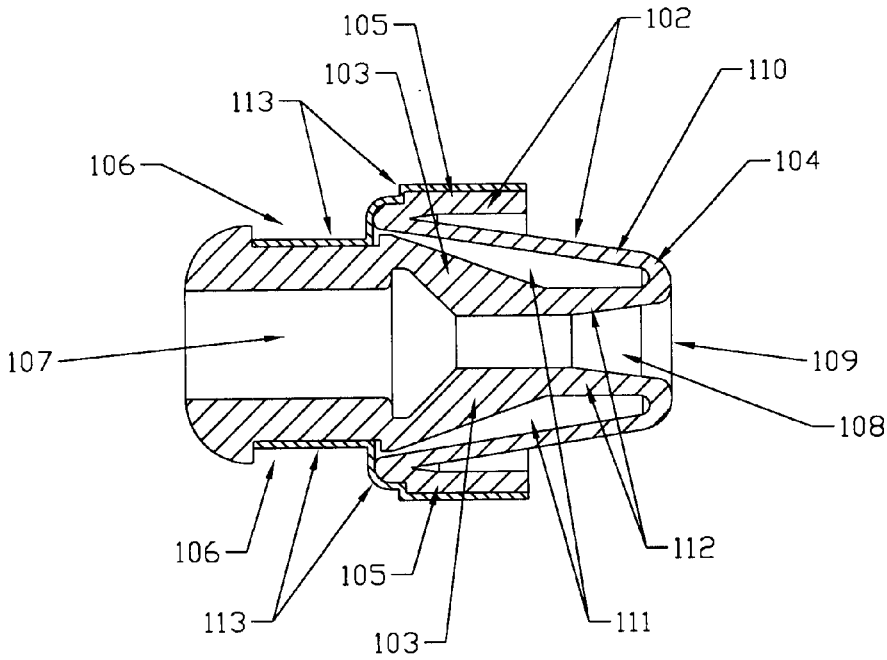
FIG. 1B depicts the elastomeric form being inverted.

FIG. 1B depicts the Top Section 102 being inverted upon it such that the Top Wall Thickness 104 establishes External Wall 110 of the Sealed Chamber 111. The Interior Wall 112 of Sealed Chamber 111 is made up of the exterior wall of the Center Auditory Passage 108, which as described above, is included in Bottom Wall 103 of greatest thickness. After the inversion of Top Section 102, Sealed Chamber 111 and Center Auditory Passage 108 are situated such that both sections come together and terminate at Audio Port Outlet 109. The Center Audio Passage 108 begins from the point at which Audio Port Outlet 109 and Bullet Point Receptacle 107 meet with the portion termed as the Bottom Section 101. Additionally, FIG. 1B shows the process of applying an Adhesive Agent 113 to both the Beveled Edge 105 and Indentation 106, and after Adhesive Agent 113 is applied to the surface of the Beveled Edge 105 and the Indentation 106 the two sections are joined, and whereby the mating features ensure that the ear tip is resistive to adhesive peel.

Figure 2A:
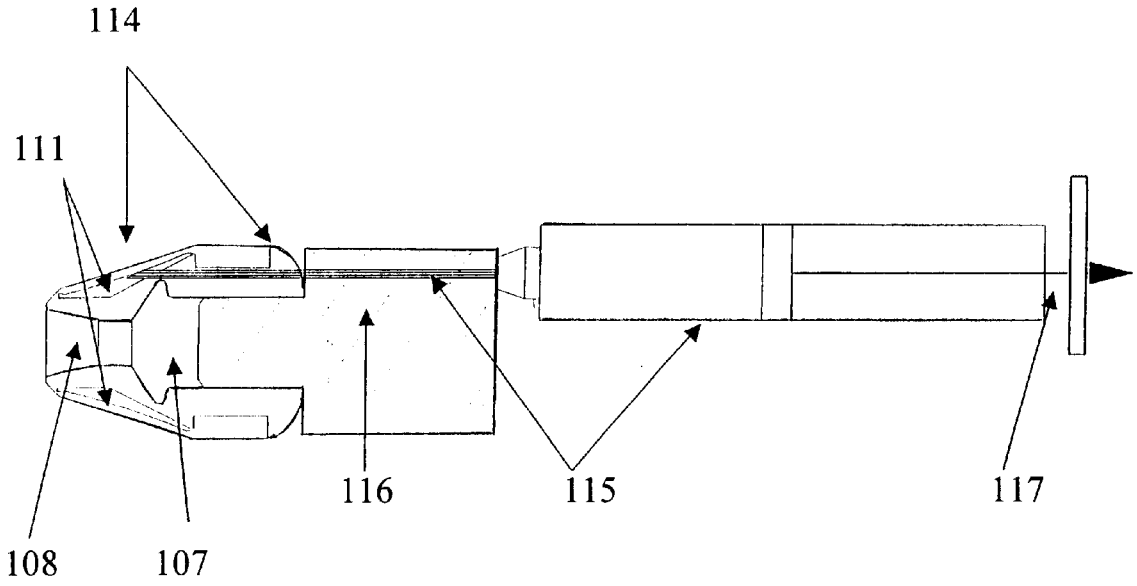
FIG. 2A depicts the air being removed from the sealed chamber.
Figure 2B:
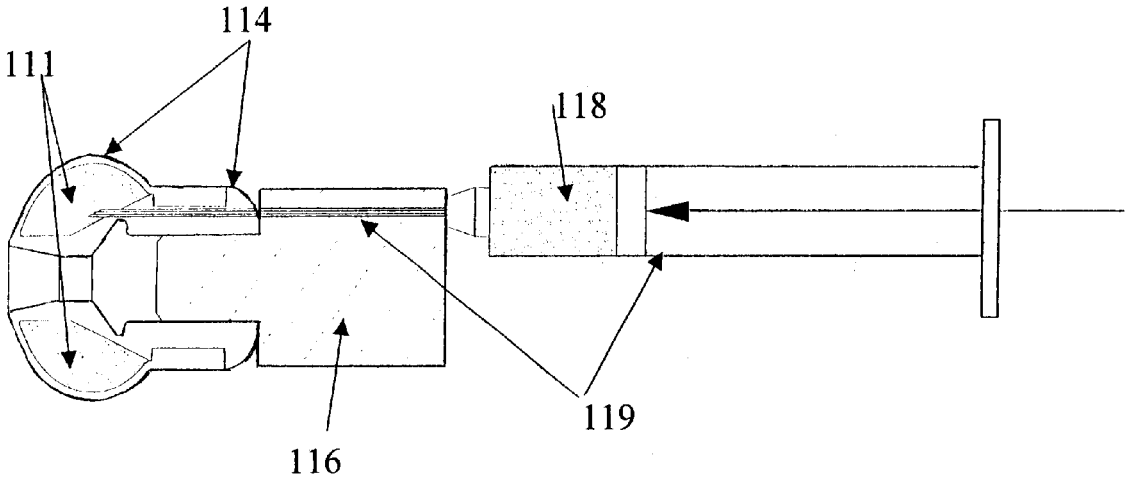
FIG. 2B depicts a displaceable material being injected into the sealed chamber.

FIG. 2A depicts the elastomeric form of Ear Tip 114 being comprised of three main sections, Sealed Chamber 111, Center Auditory Passage 108, and Bullet Point Receptacle 107. Specifically, FIG. 2A shows Sealed Chamber 111 and the method in which air is completely removed from the Sealed Chamber 111. Empty Needle 115 is inserted into the Sealed Chamber 111 through Needle Guide 116 with the Needle Plunger 117 having been depressed. The air, trapped during the sealing process described in FIG. 2B, is then entirely removed by drawing back on the plunger of Needle 115. By withdrawing the air from Sealed Chamber 111, the volume of Sealed Chamber 111 is reduced to zero (0).

Figure 3:
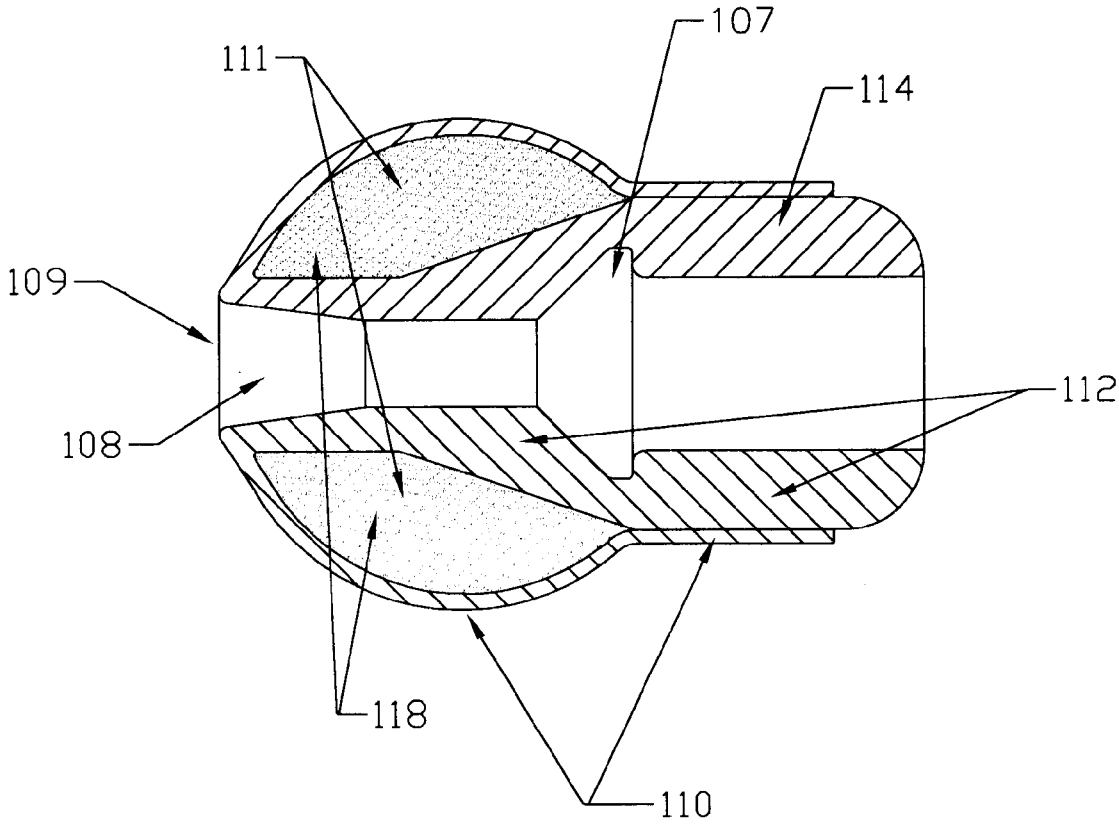
FIG. 3 depicts the ear tip having a sealed chamber filled with a displaceable matter.

FIG. 2B depicts the process by which Displaceable Substance 118 is inserted into Sealed Chamber 111. Whereas once the Sealed Chamber 111 is at zero (0) volume, pursuant to the aforementioned method or any other process of reducing the internal volume of Sealed Chamber 111 to zero (0), then Ear tip 114 is ready to be injected with Displaceable Substance 118. Displaceable Substance 118 is inserted into Sealed Chamber 111 through Needle 119, whereby Needle 119 has had Displaceable Substance 118 drawn up and then Needle 119 is placed through Needle Guide 116 to ensure that the Needle 119 is inserted the exact distance and place such that the Needle 119 just penetrates Sealed Chamber 111 thereby ensuring that Sealed Chamber 111 is filled properly and completely with Displaceable Substance 118. The amount of Displaceable Substance 118 which is injected into the Sealed Chamber 111 is such that the Sealed Chamber 111 is sufficiently flexed that only minimum amount of radial force is required for displacement of Sealed Chamber 111 so as to conform to the shape of a user's ear. Furthermore, the amount of Displaceable Substance 118 injected into Sealed Chamber 111 should not increase the volume of the Sealed Chamber 111 so that displacement is not possible because of Sealed Chamber 111 is over pressurized thereby reducing the elastomeric properties of the ear tip. After the proper amount of Displaceable Substance 118 is injected, Needle 119 is removed from Needle Guide 116 and Sealed Chamber 111, and next, Ear tip 114 is removed from Needle Guide 116. Finally, a heat seal causes the hole caused by the insertion of Needle 119 to be melted closed with an air tight seal such that the Displaceable Substance 118 is prevented from seeping out from Sealed Chamber FIG. 3 shows the elastomeric Ear tip 114 in its final form. FIG. 3 shows the three sections that when combined allow Ear tip 114 to function properly. Sealed Chamber 111 houses Displaceable Substance 118 and is comprised of Exterior Wall 110, of minimum thickness, and Interior Wall 112, which is of maximum thickness relative to Exterior Wall 110. Bullet Point Receptacle 107 is shown in FIG. 3 whereby Bullet Point Receptacle extends from the beginning of Ear tip 114 through until Bullet Point Receptacle 107 meets with Center Auditory Passage 108. Center Auditory Passage 108 is constructed such that the Center Audio Passage 108 extends unobstructed from the end of Bullet Point Receptacle 107 till Audio Port Outlet 109. The diameter through Center Audio Passage 108 is constant throughout the passage to create a true communication port, or with a diameter that increases slightly throughout the Center Audio Passage 108 towards Audio Port Outlet 109 allowing for a slight amplification of the captured sound, similar to the function of a megaphone.

We claim:

1. A moldable and contourable elastomeric ear tip, comprising a sealed airtight chamber, a first section comprising an interface mechanism for attachment to a sound transmitting device, and the center auditory passage whereby such ear tip is manufactured by:

(a) the process of injection molding to form a single piece of elastomeric material encompassing a top section and a bottom section; the top section, which forms the outer wall, has less relative thickness than the bottom section, which forms the interior wall; the outer wall of the top section of ear tip is formed having a beveled edge; the outer wall of the bottom section is formed with an indention; the inside of the bottom section houses the first section having a means for attaching the ear tip to a sound transmitting device; there is a horizontal cavity being of a constant diameter throughout both the top and bottom sections;

(b) the top section is folded over itself to the point at which the center sound passage ends; the top section is folded over itself to the point where the greater thickness in the ear tip mold meets the minimal thickness of the top section; so that the beveled edge on the top section mates with the indention on the bottom section, creating a chamber in the top section;

(c) a needle is first filled with a gelatin, whereby the needle tip is then inserted along the open seam created when the top section is flipped over itself to the bottom section into said created chamber whereby contents of said needle are disposed into said chamber until all air has been removed therefrom, said needle tip is then removed from ear tip, (d) the chamber is then permanently sealed using techniques whereby said sealed chamber is airtight and whereby said sealing creates a seamless interface between the top section and the bottom section, a first section comprising the interface mechanism, and a center auditory passage; the center auditory passage being formed by the inner wall of the sealed chamber having a greater thickness compared to that of the outer wall, the relative difference in thickness preventing the airtight chamber from obstructing the auditory passage, achieving minimum variation in the diameter of the center auditory passage.

2. The ear tip of claim 1 having a means of attachment to the stethoscope binaural comprising an opening within the ear tip of a specific shape, referred to as the Bullet Point receptacle, that allows the binaural of the same shape to be inserted into the first section for a secure fit of the ear tip preventing unwanted disengagement of the ear tip from the listening device.

3. The ear tip as disclosed in claim 1, whereby in utilizing the principles of displacement, during the application of varying applied forces a fixed volume of said pliant material is maintained within the sealed chamber such that the volume of the sealed chamber prior to displacement is equal to the volume of the sealed chamber subsequent to displacement, and whereby such principles allow the second section of disclosed ear tip to deform to the variations in the configuration of the user's outer ear.

4. The ear tip as disclosed in claim 1 that, through the utilization of the inward compression forces of the typical stethoscope ear pieces, said compression forces expand ear tip thereby creating an acoustic seal having a complete and continuous contact surface with the user's outer auditory canal.

5. The ear tip as disclosed in claim 1 that is filled with a gelatinous substance and said substance does not freeze at negative 46.5 degrees Celsius or boil at positive 100 degrees Celsius.

6. The ear tip as disclosed in claim 1 is filled with a pliant material to which various colors are added, whereby said color is held in suspension by pliant material, whereby said color does not settle if said ear tip remains static for several weeks.

7. The ear tip as disclosed in claim 1 is filled with a gas.

8. The ear tip as disclosed in claim 1 is filled with a liquid.

9. The ear tip as disclosed in claim 1 is manufactured such that the ear tips, when attached to a stethoscope ear piece and placed within the user's ear, remain outside of the inner ear canal and do not penetrate said inner ear canal more than one-eighth of an inch, whereby said ear tip does not penetrate user's inner ear canal and remains on the outside of said inner ear canal to facilitate rapid insertion and removal of the ear tip without causing discomfort to the user.

10. The ear tip as disclosed in claim 1 is manufactured with an elastomer impregnated with anti-microbial agents.

11. The ear tip as disclosed in claim 1 is sprayed with an anti-microbial agent after manufacture is complete.

* * * * *